United States Patent [19]

Meyer et al.

[11] Patent Number: 4,720,233

[45] Date of Patent: Jan. 19, 1988

[54] TRACTOR FRAME FOR TRACTOR-MOUNTED IMPLEMENT

[75] Inventors: Paul A. Meyer, Mayville; Michael Bedis, Oconomowoc, both of Wis.

[73] Assignee: Deere & Company, Moline, Ill.

[21] Appl. No.: 904,847

[22] Filed: Sep. 5, 1986

Related U.S. Application Data

[63] Continuation of Ser. No. 675,787, Nov. 28, 1984, abandoned.

[51] Int. Cl.[4] ..... E02F 3/627

[52] U.S. Cl. ..... 414/686; 172/273; 403/379

[58] Field of Search ..... 414/686; 172/272–275; 403/378, 379

[56] References Cited

U.S. PATENT DOCUMENTS

| | | | |
|---|---|---|---|
| 1,925,419 | 9/1933 | Swenson | 403/379 |
| 2,239,387 | 4/1941 | Johnson | 172/273 |
| 2,361,362 | 10/1944 | Altgelt | 172/273 X |
| 2,546,199 | 3/1951 | Pitcher et al. . | |
| 2,619,242 | 11/1952 | Crampton et al. . | |
| 2,630,930 | 3/1953 | Ulrich . | |
| 2,962,104 | 11/1960 | Antici | 172/274 X |
| 3,209,930 | 10/1965 | Derruppe . | |
| 3,484,125 | 12/1969 | Randour . | |
| 3,949,889 | 4/1976 | Moe | 414/786 |
| 4,266,906 | 5/1981 | Langenfeld et al. | 414/686 |
| 4,470,751 | 9/1984 | Masuzawa et al. | 403/379 X |
| 4,538,955 | 9/1985 | Langenfeld et al. | 414/686 |

*Primary Examiner*—Leslie J. Paperner

[57] ABSTRACT

A tractor-implement combination comprising a tractor frame supported on front and rear wheels and having left and right side plate means has a horizontal tube structure extending through the side plate means to oppositely, transversely spaced open ends. A transverse beam is slidably mounted within the tube and has opposite end portions projecting transversely outwardly of the open ends of the tube. A pair of implement supports detachably secured to said end portions and an implement is carried on the implement supports.

7 Claims, 6 Drawing Figures

22
24
26
30
32
34
35
36
37
38
39
40
42
50
51
52
53
54
55
56
57
58
60
61
62
63
64
65
66
82

TRACTOR FRAME FOR TRACTOR-MOUNTED IMPLEMENT

This application is a continuation of application Ser. No. 675,787, filed Nov. 28, 1984, now abandoned.

BACKGROUND OF THE INVENTION

This invention relates to a tractor-implement combination, more particularly to a tractor-loader combination and even more particularly to an improved vehicle frame having an integral member formed therewith which can be utilized as means for mounting implements to the vehicle frame. In many of the small utility-type tractors, when it is desired to mount a power loader or other implement on the tractor, it is often necessary to provide a complete sub-frame that underlies the tractor frame and which may be connected to the tractor frame at the front and rear portion of the tractor frame. The implement sub-frame generally underlies the tractor and implement supports such as vertical posts on a loader are carried on this subframe. The greatest problem with this type of mounting arrangement is that the small utility tractors are often used for more than one job. For example, in a utility tractor, a mower may be mounted on the tractor when it is desired to mow grass or small crops. When it is desired to cultivate or till ground, another type of implement frame may be required. Likewise, when it is desired to mount a loader on the tractor frame, it becomes a tedious job for the reason that the tractor, being of a small size, has its underside relatively close to the ground and it is difficult to mount a loader sub-frame on the underside of the tractor. Often, it is necessary to raise the small tractor completely off of the ground and to insert the loader frame or to roll the tractor on its side for mounting the loader frame. Also, while a loader frame may be relatively small, it nevertheless weighs sufficiently so that it is difficult for one man to mount the whole loader frame on the tractor.

SUMMARY OF THE PRESENT INVENTION

With the above in mind, it is the primary purpose of the present invention to provide a tractor frame which not only serves to support the tractor, but also serves partially as the loader or other implement frame. More specifically, it is the purpose of the present invention to provide a tractor frame composed of vertical side plates that are rigidly interconnected by transverse beam means, one of which is located at a fore-and-aft mid-portion of the frame and which is a transverse tubular member that extends through both side plates and has open ends outwardly, respectively of the side plates.

The implement or loader frame is composed of a basic transverse tubular beam that is slidable within the tractor tubular member and has opposite end portions projecting outwardly, respectively of the open ends of the tractor tubular member. The posts of the loader are detachably supported on this transverse beam on the end portions thereof. Loader lift arms are, of course, supported on the post, as are likewise the lift cycles that extend between the posts and the lift arms. The tubular beams of the loader frame is held against transverse movement with respect to the tractor by bolts that extend diagonally through both the tractor tube and loader beam. The bolts, when tightened, also prevent vibrations and shifting of the loader beam with respect to the tractor tube.

Other objects and advantages of the invention will be apparent from the following description, accompanying drawings and the appended claims.

DESCRIPTION OF THE PREFERRED EMBODIMENT

Figure 1:
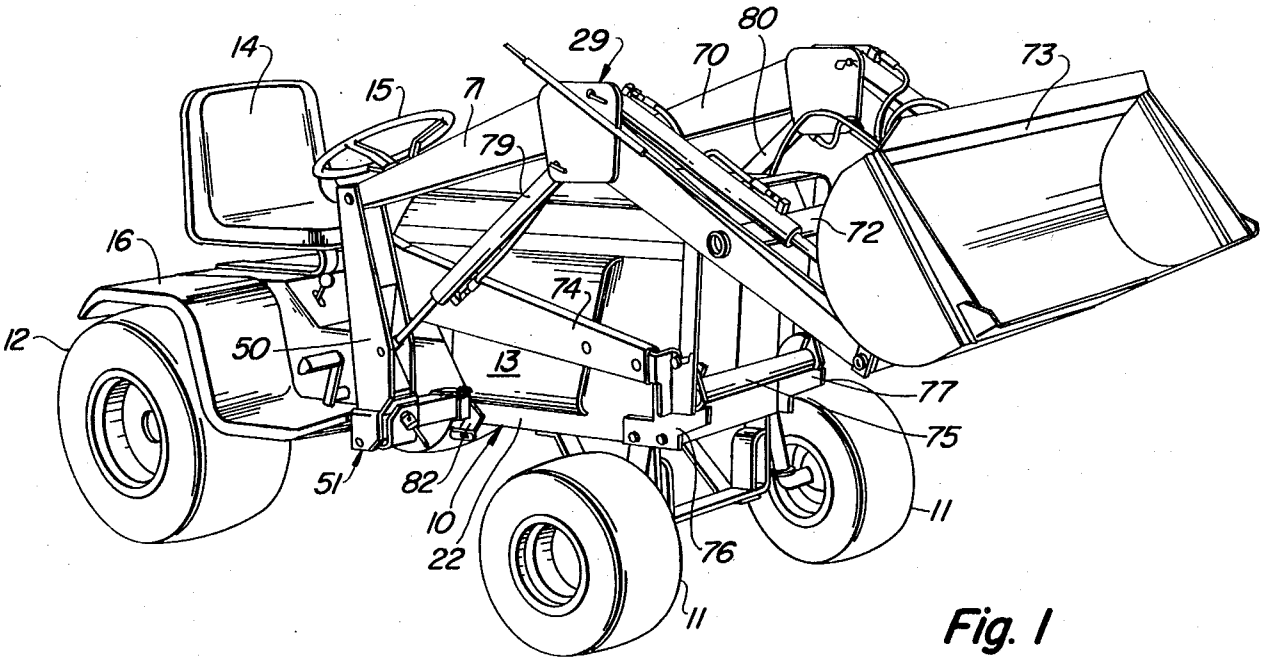
FIG. 1 is a front side perspective view of a tractor-loader combination which incorporates the frame structures of the present invention.
Figure 2:
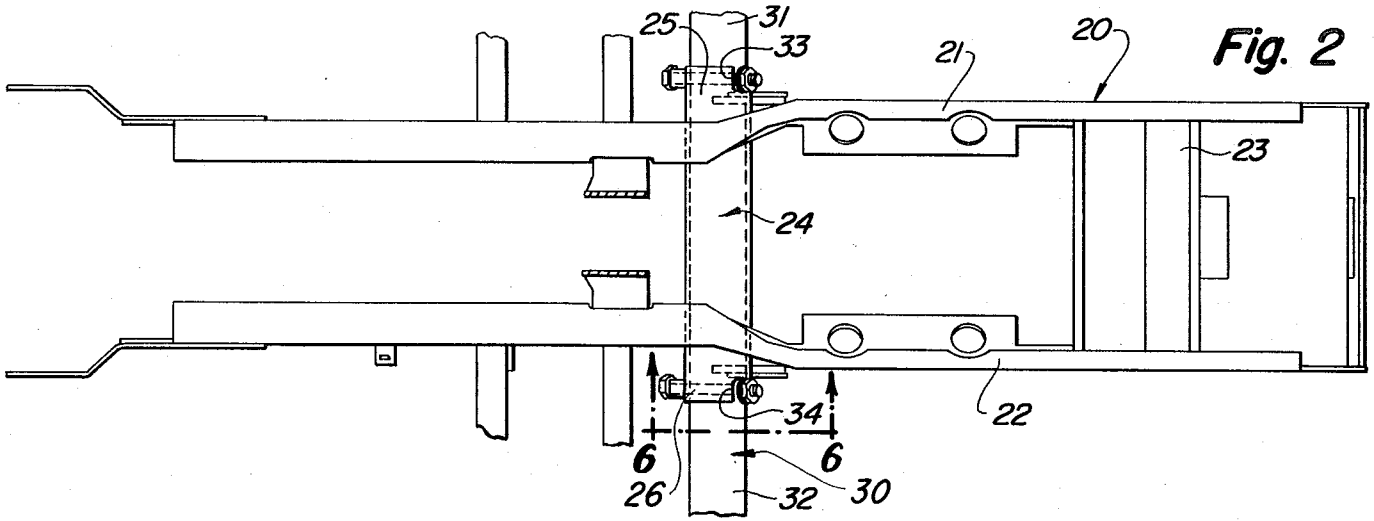
FIG. 2 is a plan view of the tractor frame showing a portion of the loader frame mounted on the tractor frame.
Figure 3:
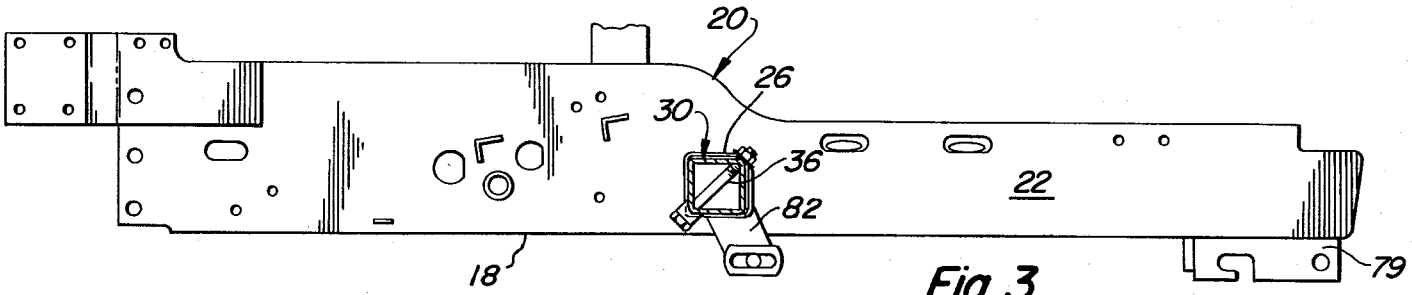
FIG. 3 is a side view of the tractor frame structure and loader frame portion shown in FIG. 2.

For purposes of the present description, left and right and front and rear shall denote directions as viewed by an operator sitting on the tractor seat and facing in the forward direction of travel.

The tractor 10 is composed of front and rear pairs of wheels 11, 12, respectively, and an engine, which is not shown, but carried under a tractor hood 13. An operator's station, indicated by a tractor seat 14 and steering wheel 15, is provided on the rear portion of the tractor, as is a rear fender deck 16. The tractor 10 is supported on the wheels 11, 12 by a tractor frame, indicated in its entirety by the reference numeral 20, composed of left and right-hand side plate means 21, 22 of channel construction and interjoined by transverse beam means 23 at the front end, and a transverse rectangular structural tube 24 at the fore-and-aft mid portion of the frame 21. Specifically, the plate means 21, 22 each include upper and lower flanges extending over substantially the entire length of the plate means with the lower flanges defining a horizontal bottom 18 of the frame which extends substantially the entire length of the frame. The tubular structural member 24 extends through the respective side plate means 21, 22 at respective locations above the horizontal bottom 18 of the frame and has open ends 25, 26 outboard of the side plate means 21, 22, respectively. Other than the shape and nature of the structure of the tractor frame 20, the tractor is of conventional nature, having the usual hydraulic systems, brake systems, and steering systems, etc.

An implement in the form of a power loader 29 is supported on the tractor 10 by a basic rectangular-shaped structural tube member 30 that extends through the structural member 24 of the tractor frame and has opposite end portions 31, 32 projecting outwardly of the open ends 25, 26 of the tubular member 24. While the preferred form of the invention shows tubes 24, 30 to be rectangular in cross-section, it should be understood that other cross-sectional shapes, such as round, triangular, etc., would be satisfactory. In cross-section, the two tubular members 24, 30 are complimentary in the sense that the dimensions of the outer sides of the loader tube member 30 are substantially the same, although slightly smaller, than the inner dimension of the tubular structural member 24. The tubular member 30 may slide or telescope transversely in the tubular member 24. Being rectangular shaped, the members 24, 30 cannot rock or rotate relative to one another. The tubular ends 25, 26 of the tubular frame member 24 have cut-outs or notches 33, 34 at those ends and in the upper forward corner of the ends. Aligned diagonally with the notches 33, 34 and positioned in the lower rear corner of the respective tubular member are bolt openings, only one of which is shown at 35 in FIGS. 4 and 6, that receive bolts, such as at 36.

Figures 4, 5:
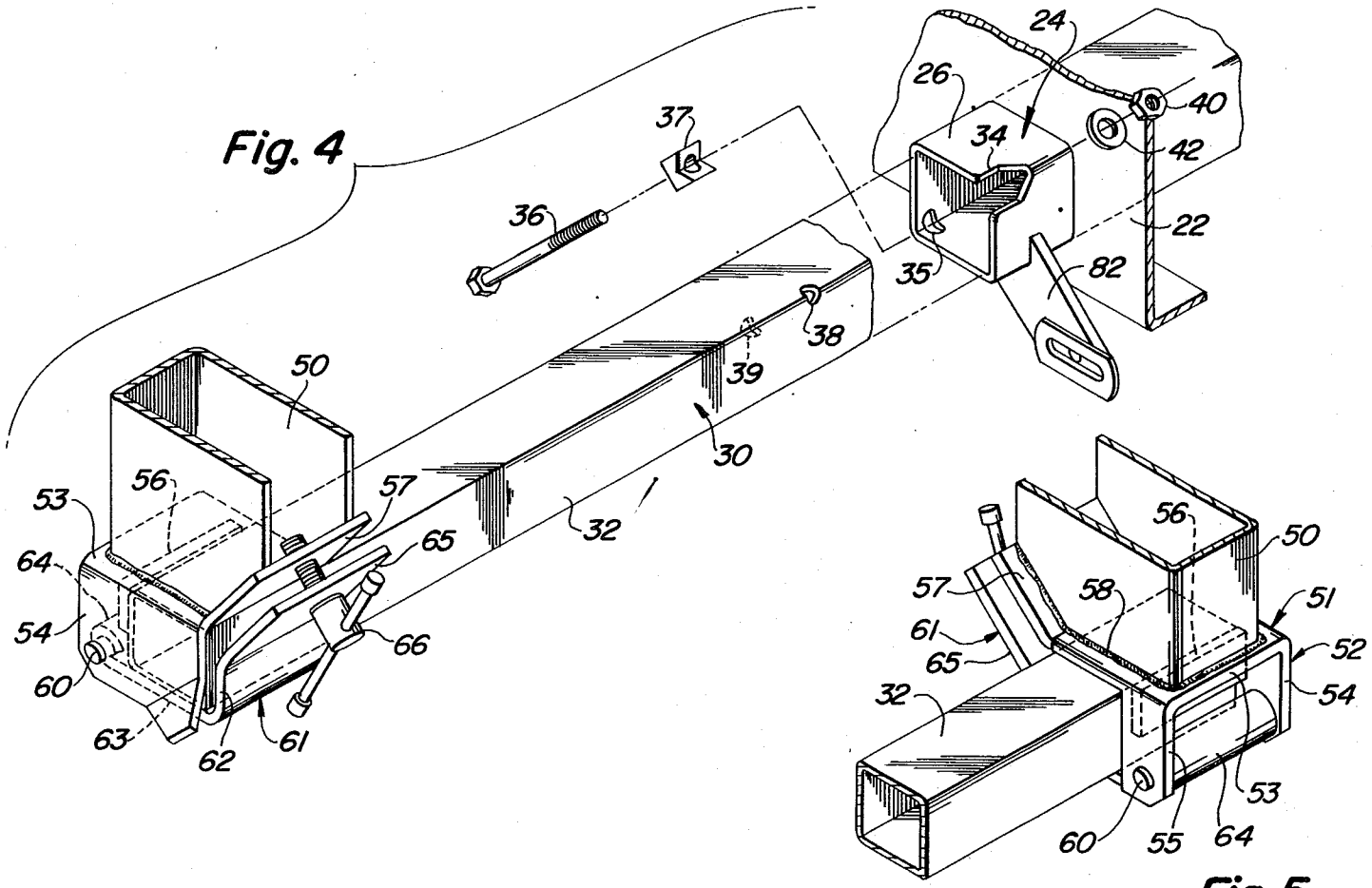
FIG. 4 is an exploded view showing a small portion of the tractor frame, and portions of the loader frame and loader.
FIG. 5 is a perspective view of the lower end of the right loader post and its mounting clamp as taken from the rear inner side thereof.
Figure 6:
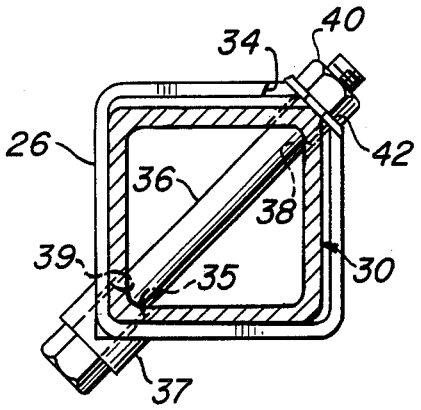
FIG. 6 is an enlarged sectional view taken along the line 66 of FIG. 2.

Referring now to FIGS. 4 and 6, carried on the bolt 36 is a washer 37 that is shaped to conform to the shape of the outer corner of the tubular end portion 26. The loader structural tube 30 has diagonally aligned bolt holes 38, 39 that align with the notch 34 and opening 35 and receive the shank of the bolt 36. The bolt has an internally threaded part or nut 40 and a suitable washer 42 that is received in the notch 34. The washer 42 bears against the upper forward corner of the tubular structural member 30 and, when tightened, draws the structural tube 30 to fit tightly against the inner, lower corner surfaces of the tubular member 26, such being shown clearly in FIG. 6. It should also be recognized that while only the right-hand side of the tractor tube 24 and loader tube 30 is shown in FIGS. 4 and 6, a similar arrangement is provided for the left-hand side connection between the structural tubes 24 and 30.

The loader 29 also includes a pair of upright posts, only one of which is shown at 50, at the right-hand side of the tractor. As is obvious from viewing FIG. 1 and to one skilled in the art of loader manufacture, a similar post, while not shown, is provided on the left-hand side of the tractor. Details of the mounting arrangement between the posts 50 and the outer end 32 of the loader frame tube 30 is shown in FIGS. 4 and 5. It should be understood that a similar mounting arrangement is provided for the left-hand post.

Referring now specifically to FIGS. 4 and 5, the post 50 is detachably mounted on the outer end portion 32 of the beam 30 by means of a clamp, indicated in its entirety by the reference numeral 51. The clamp is composed of a main downwardly opening U-shaped member 52 having a horizontal section 53 and depending transversely spaced leg portions 54, 55. The plate or leg portions 54, 55 are vertical, fore-and-aft extending elements that are integral with the plate portion 53. The innermost plate portion 55 is cut out so as to receive the upper rear corner of the beam portion 32. The outermost plate portion 54 lies alongside the end of the outer beam portion 32 and closes the open end of the beam or tube 30. It also serves to guide the loader post on the beam portion 32 when the loader is being mounted thereon. A transverse filler plate 56 extends between and is welded to the inner surfaces of the vertical leg portions 54, 55 and abuts against the rear surface of the outer beam portion 32. It serves to properly position the beam portion 32 with respect to the clamp member 52. The horizontal plate portion 53 has at its forwardmost end an inclined section 57. As can best be seen from viewing FIGS. 4 and 5, the vertical wall 56 and the bottom wall 53 of clamp member 52 fit against the rear vertical surface and the horizontal upper surface of the beam portion 32. A horizontal transverse hinge pin 60 extends between the walls 54, 55 adjacent the rear lower corner of the beam portion 32.

A lower clamp member 61 has a lower horizontal wall 63 fitting against the underside of the beam portion 32 and a vertical wall 62 that bears against the forward vertical surface of the beam portion 32. The bottom wall 63 has a rolled hinged end 64 that fits around the pin 60. As can best be seen, the entire clamp member 61 is hinged on the pin 60. Also, as is clear from viewing FIGS. 4 and 5, the lower hinge member 61, when in place, has the front wall 62 and the lower wall 63 bearing against the front vertical surface and the lower horizontal surface of the end portion 32 of the tube 30. The lower clamp member 61 terminates in its front side in an inclined wall portion 65. A hand bolt 66 extends through the wall 65 and is threadably received in the inclined wall 57 of the other clamp member. Thus, the bolt 66 may be adjusted to tighten the clamp on the end portion 32 of the tube 30. Similarly, the clamp may be detached from the end portion 32 by loosening the bolt 66 until the post 50 and the respective clamp 51 can be disconnected from the end portion 32, or in some instances slid off the end of the member 30.

Referring again to FIG. 1, the loader is composed of the two posts 50 and a pair of lift arms 70, 71 that extend forwardly from the respective posts and are rigidly interconnected first by a transverse tube member 72 and then by a loader bucket 73. Wrap-around framework, composed of side beams 74, extend forwardly from the respective posts 50 and to a front transverse tube member 75 that fits adjacent to but forwardly of the tractor. Carried on the forward part of the wrap-around framework are downwardly extending brackets 76, 77 that are detachably mounted by being bolted to the tractor and serve to mount the forward end of the loader frame on the tractor. Hydraulic cylinders 79, 80 extend from the respective posts 50 to the lift arms 70, 71.

When mounting the loader on the tractor, the tubular beam is inserted in the tractor frame tube 24 until the openings 38, 39 are properly aligned with the opening 35 and slot 34 of the tractor frame tube 24. The bolts 36 are then properly inserted and the nuts 40 are tightened down so as to hold the loader frame tube 30 against axial and vibration-type motion. At this time, the tractor can be driven under a raised rear end of the post 50 until the clamp ends are properly aligned with the outer end portions of the tube 30. The hydraulic cylinders 75 may then be adjusted in length to drop the respective clamps on the end portions 31, 32 of the tube 30. The clamp portion 61 is then manually closed and tightened until the post is rigid with the end portion 32. It should, however, be understood that the manner of mounting the loader on the tractor other than providing a detachable connection 51 and the telescoping and locking of the beam or tube members 24, 30 together, is not a part of this invention, and other mounting arrangements could be utilized.

While only a loader has been shown mounted on the square sectioned support tube 30, it should be understood that other implements could have their supports clamped to the sub-frame beam 30. Also, it should be understood that the small utility or lawn and garden tractor must be versatile in its use. For example, while a loader is shown, mowers and snow removal equipment are also available for mounting on the tractor. To this end, there is shown a bracket 82 on the right end of the beam tube 24. This is for the purpose of hanging a mower deck on the underside of the tractor. Similar brackets could be detachably mounted or clamped on the beam 30 for supporting a mower deck, snow blower, or other small implements.

While the forms of apparatus herein described constitute preferred embodiments of this invention, it is to be understood that the invention is not limited to these precise forms of apparatus and that changes may be made therein without departing from the scope of the invention which is defined in the appended claims.

We claim:

1. A tractor-loader combination comprising: a fore-and-aft extending tractor frame supported on front and rear transversely spaced wheels and having left and right side plate means defining a substantially horizontal bottom extending substantially the entire length of the frame, and a horizontal transverse structural tube structurally interconnected and extending through the side plate means at respective locations spaced above said horizontal bottom, for making said frame rigid, the tube including opposite transversely spaced open ends opening outwardly of the plate means and being located longitudinally between the front and rear wheels; a transverse beam extending through the tube and having opposite end portions projecting transversely outwardly of said spaced open ends; a notch and an opening aligned with the notch being provided in each end portion of the structural tube, opening means provided in the beam in alignment with each aligned notch and opening in the tube, a threaded member extending through the aligned notch opening and opening means and an internally threaded part received on the threaded member so that the tube and beam may be rigidly connected to one another; a pair of upright posts having lower ends detachably secured in rigid fashion respectively to said end portions; a pair of bucket-supporting loader lift arms pivotally mounted on the posts respectively to swing vertically on opposite sides of the tractor; and cylinder means extending between and connected respectively to the lift arms and posts.

2. The invention defined in claim 1, characterized by said structural tube and said transverse beam being rectangular in cross section with the latter being slightly smaller than the former in size so that it may slide through said former.

3. The invention defined in claim 1 in which the threaded member is a bolt and the threaded part is a nut seatable in the notch.

4. The invention defined in claim 3 in which the transverse beam is also a tube and the opening means is defined by a pair of openings located in diagonally opposite corners of the beam.

5. In a tractor-implement combination in which the tractor has a tractor frame supported on front and rear transversely spaced wheels and having left and right side plate means extending substantially the entire length of the frame, the improvement comprising:

said plate means defining a horizontal bottom extending substantially the entire length of the frame;

a horizontal transverse structural tube fixed to and extending through the side plate means at respective locations above said bottom and having opposite transversely spaced open ends located outwardly of the plate means, said structural tube being located longitudinally between the front and rear wheels;

a transverse implement beam extending through the tube and having opposite end portions projecting transversely outwardly of said spaced open end said tube having a notch therein and said beam and said tube having alignable openings therein and characterized by a nut and bolt assembly that extends through the openings and has one end located in the notch and seated against the beam and the other end seated against the outside of the tube whereby, as the nut is retracted on the bolt, the assembly will draw an outer surface of the beam into tight contact with an inner surface of the tube; and implement supports detachably mounted on said end portions and connected to an implement for carrying the implement on the tractor.

6. The invention defined in claim 5 in which the tube and beam are so shaped that they will telescope transversely relative to one another but will not rotate with respect to one another.

7. The invention defined in claim 6 in which the beam and tube are rectangular in cross section with the beam having an outer surface complementary to but slightly smaller than the inner surface of the tube.

* * * * *